US007905571B2

(12) United States Patent
Byun

(10) Patent No.: US 7,905,571 B2
(45) Date of Patent: Mar. 15, 2011

(54) WASTE INK CONTAINER, WASTE INK STORING APPARATUS AND INKJET PRINTER INCLUDING THE SAME

(75) Inventor: Chang-soo Byun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 441 days.

(21) Appl. No.: 12/099,250

(22) Filed: Apr. 8, 2008

(65) Prior Publication Data

US 2008/0316254 A1 Dec. 25, 2008

(30) Foreign Application Priority Data

Jun. 21, 2007 (KR) ..... 10-2007-0061084

(51) Int. Cl.
*B41J 2/165* (2006.01)

(52) U.S. Cl. ..... 347/36; 347/20; 347/22; 347/29; 347/31; 347/32; 347/34; 347/35

(58) Field of Classification Search ..... 347/29, 347/31, 32, 34, 35, 36
See application file for complete search history.

(56) References Cited

U.S. PATENT DOCUMENTS

| | | | | |
|---|---|---|---|---|
| 4,970,535 | A * | 11/1990 | Oswald et al. | 347/25 |
| 5,291,227 | A * | 3/1994 | Suzuki | 347/104 |
| 5,563,639 | A * | 10/1996 | Cameron et al. | 347/34 |
| 5,742,303 | A * | 4/1998 | Taylor et al. | 347/36 |
| 6,050,671 | A * | 4/2000 | Rotering | 347/35 |
| 6,168,258 | B1 * | 1/2001 | Lou et al. | 347/33 |
| 6,293,641 | B1 * | 9/2001 | Yoshimura et al. | 347/14 |
| 6,322,196 | B1 * | 11/2001 | Lim | 347/35 |
| 6,328,491 | B1 * | 12/2001 | Beehler et al. | 400/648 |
| 6,357,853 | B1 * | 3/2002 | Askren et al. | 347/36 |
| 6,375,304 | B1 * | 4/2002 | Aldrich et al. | 347/35 |
| 6,565,189 | B2 * | 5/2003 | Yamada et al. | 347/36 |
| 6,572,294 | B2 * | 6/2003 | Beehler et al. | 400/648 |
| 6,644,778 | B2 * | 11/2003 | Rotering | 347/35 |
| 6,857,721 | B2 * | 2/2005 | Salzer | 347/36 |
| 7,396,105 | B2 * | 7/2008 | Toki et al. | 347/35 |
| 2001/0020962 | A1 * | 9/2001 | Kanaya et al. | 347/24 |
| 2003/0112289 | A1 * | 6/2003 | Berg et al. | 347/36 |

* cited by examiner

*Primary Examiner* — Ryan Lepisto
(74) *Attorney, Agent, or Firm* — Stanzione & Kim, LLP

(57) ABSTRACT

A waste ink container includes a container main body which forms a chamber to accumulate waste ink therein. An upper plate covers an upper part of the chamber and includes an opening to introduce a plurality of waste ink droplets therethrough. A waste ink containment device includes a discharge preventing unit which is adjacent to the opening and extends from the upper part of the chamber to inhibit the waste ink droplets from being discharged through the opening.

26 Claims, 8 Drawing Sheets

WASTE INK CONTAINER, WASTE INK STORING APPARATUS AND INKJET PRINTER INCLUDING THE SAME

CROSS-REFERENCE TO RELATED APPLICATIONS

This application claims priority from Korean Patent Application No. 10-2007-0061084, filed on Jun. 21, 2007 in the Korean Intellectual Property Office, the disclosure of which is incorporated herein in its entirety by reference.

BACKGROUND OF THE INVENTION

1. Field of the Invention

The present general inventive concept relates to waste ink collection, and more particularly, to a waste ink container which prevents waste ink from being discharged exterior thereto.

2. Description of the Related Art

An inkjet printer ejects an ink droplet from a nozzle of a printing head onto a printing medium to form an image. The inkjet printer includes an ink cartridge which stores ink and supplies it to the printing head.

Generally, if the nozzle is clogged by impurities, the amount of ink ejected through the nozzle is diminished. Thus, the inkjet printer performs a nozzle-cleaning operation to remove the impurities from the nozzle.

The nozzle-cleaning operation is performed by discharging the ink of the ink cartridge out of the printing head through the nozzle, which is generally referred to as an "ink-spitting" operation. To capture the ink discharged out of the printing head during the ink-spitting operation, the inkjet printer includes a waste ink container to store the discharged ink (hereinafter, referred to as 'waste ink').

The waste ink is discharged through the nozzle in droplets of small size (or volume). As the number of nozzles per unit length increases to improve resolution in dots per inch (DPI) of the inkjet printer, the sizes of the droplets of the waste ink become correspondingly smaller. Consequently, some of the waste ink in the waste ink container is in an aerosol state and diffuses, or is carried with an air flow, within the inkjet printer.

Conventional solutions to the foregoing problems include a waste ink container in which a waste ink droplet is introduced through an opening, but is discharged to the outside through the opening by external force. In this case, the internal part of the inkjet printer may be contaminated by the waste ink droplet. Also, if the waste ink droplet contaminates a printing medium which is being printed, printing quality may be lowered.

Also, in the conventional inkjet printers, a printing head ejects ink in a transverse direction to a direction of gravity. Thus, the waste ink droplet may not pass through the opening and, instead, be introduced outside the waste ink container, thereby raising a possibility of contaminating the internal part of the inkjet printer.

SUMMARY OF THE INVENTION

Accordingly, it is an aspect of the present general inventive concept to provide a waste ink container that prevents waste ink from being discharged to the outside of the waste ink container, a waste ink storing apparatus and an image forming apparatus including the same.

Also, it is another aspect of the present general inventive concept to provide a waste ink container that prevents contamination of an internal part of an inkjet printer with waste ink, a waste ink storing apparatus and an image forming apparatus including the same.

Further, it is another aspect of the present general inventive concept to provide a waste ink container that improves printing quality, a waste ink storing apparatus and an image forming apparatus including the same.

Additional aspects and/or advantages of the present general inventive concept will be set forth in part in the description which follows and, in part, will be obvious from the description, or may be learned by practice of the present general inventive concept.

The foregoing and/or other aspects and utilities of the present general inventive concept can be achieved by providing an ink container, including a container main body which forms a chamber to accommodate ink therein, an upper plate which comprises an opening to introduce a ink droplet therethrough and covers an upper part of the chamber, and a waste ink containment device having a discharge preventing unit which is adjacent to the opening and inhibits the ink droplet from being discharged through the opening.

The waste ink containment device may further include an introduction guide which is disposed within the chamber and extends from the upper plate toward inside of the chamber, and guides the ink droplet toward the chamber through the opening.

The introduction guide may include a first protrusion to increase a contact area thereof with the ink droplet.

The upper plate further may include a second protrusion facing the chamber which increases a contact area of the upper plate with the ink droplet.

The foregoing and/or other aspects and utilities of the present general inventive concept can also be achieved by providing a waste ink storing apparatus. The waste ink storing apparatus includes an ink container which includes a container main body which forms a chamber to accommodate ink therein, an upper plate which comprises an opening to introduce a plurality of ink droplets therethrough and covers an upper part of the chamber, and a waste ink containment device having a discharge preventing unit which is adjacent to the opening and resists the ink droplets being discharged through the opening and a cover member which opens and closes the opening.

The cover member may open and close the opening by engaging with the movement of an ink-ejecting means which ejects the ink droplet.

The foregoing and/or other aspects and utilities of the present general inventive concept can also be achieved by providing an inkjet printer, including a printing head which includes a nozzle to eject ink therethrough, and moves between a printing position to print on a printing medium and a nozzle-cleaning position distanced from the printing position, and an ink container including a container main body which forms a chamber to accommodate ink therein, an upper plate which comprises an opening to introduce a plurality of ink droplets therethrough and covers an upper part of the chamber, and a waste ink containment device that includes a cover member exterior to the container main body which opens and closes the opening.

The waste ink containment device may further include an introduction guide which is disposed within the chamber and extends from the upper plate toward inside of the chamber, and guides the ink droplets into the chamber upon being introduced through the opening.

The introduction guide may include a first protrusion to increase a contact area with the ink droplets.

The upper plate further may include a second protrusion which increases a contact area with the ink droplets and faces the chamber.

The inkjet printer may further include a discharge preventing unit interior to the container main body adjacent to the opening to inhibit the ink droplets from being discharged through the opening.

The cover member may move between an opening position to open the opening and a closing position to close the opening in engagement with movement of the printing head moving between the nozzle-cleaning position and the printing position.

The cover member may be provided to slidably move parallel to the movement of the printing head.

The inkjet printer may further Include an ink cartridge which stores ink therein, and moves integrally with the printing head, wherein the cover member engages and disengages the ink cartridge, and opens and closes the opening in engagement with the movement of the ink cartridge.

The inkjet printer may further include an elastic member which applies an elastic force to the cover member to close the opening when the cover member disengages the ink cartridge.

Additional aspects and/or utilities of the present general inventive concept may also be achieved by providing a waste ink receptacle including at least one opening through which waste ink is received. A waste ink containment device is provided having a lower wetting surface disposed at least partially across the opening to accumulate droplets of the waste ink thereon to form ink drops, an upper wetting surface adjacent to the opening to accumulate aerosol droplets of the waste ink thereon to form other ink drops, a discharge preventing unit formed between the upper wetting surface and the opening to inhibit the aerosol droplets from movement into the opening. A chamber collects the ink drops and the other ink drops upon being released from the lower wetting surface and the upper wetting surface, respectively.

Additional aspects and utilities of the present general inventive concept are also achieved by providing an inkjet printing apparatus including at least one print head to print indicia on a printing medium with ink supplied thereto, the print head being selectively removed from a printing region at which the printing medium is provided to a cleaning region removed from the printing region and at which the print head forcibly ejects the ink to clean nozzles formed therein. The inkjet printing apparatus includes a waste ink container at the cleaning region to receive the ink forcibly ejected by the print head as waste ink thereat, the waste ink container including an upper plate having formed therein an opening to receive the waste ink therethrough, and a chamber to collect the waste ink. A waste ink containment device is provided and includes a discharge prevention unit having a proximal end thereof coupled to the upper plate and having a distal end thereof in a predetermined arrangement with the upper plate to inhibit the waste ink from movement into the opening.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
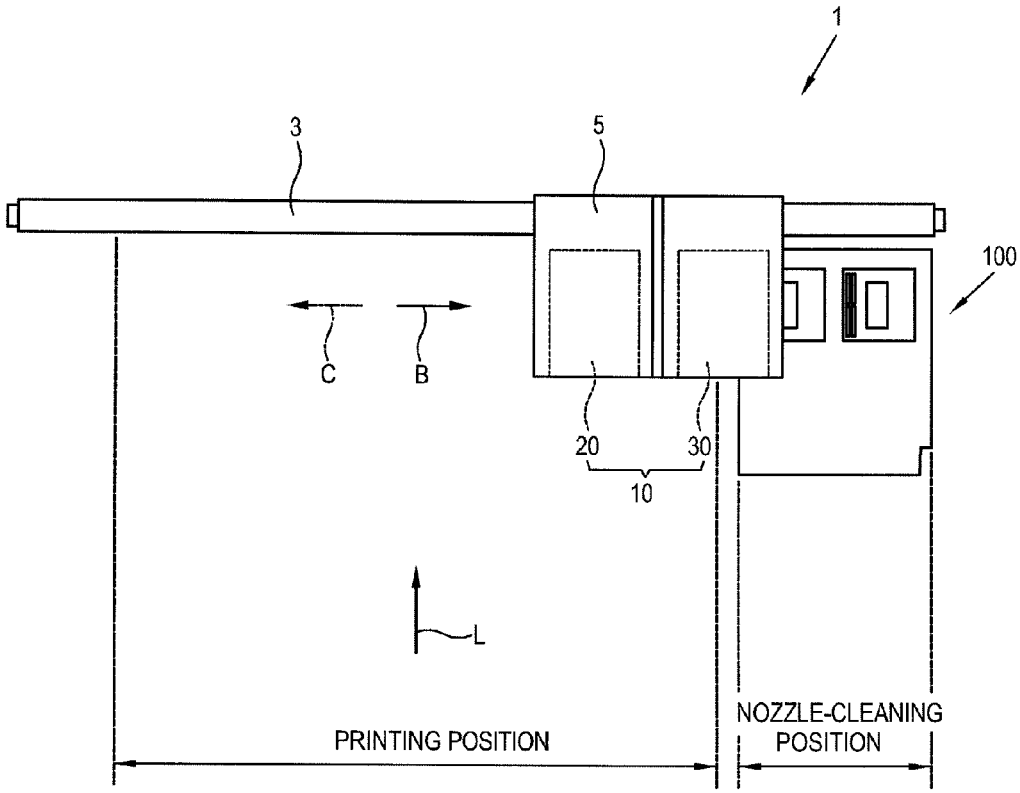
FIG. 1 is a plan view of certain components of an exemplary inkjet printer according to the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

According to embodiments of the present general inventive concept, a waste ink containment device 300 (refer to FIG. 6) is deployed at a waste ink receptacle, such as a waste ink container or a waste ink storage apparatus, to allow waste ink to be introduced into the waste ink receptacle, but to inhibit the waste ink from exiting the waste ink receptacle. As will be illustrated through the exemplary embodiments described below, the waste ink containment device 300 may have elements within and exterior to the waste ink receptacle.

As illustrated in FIG. 1, an inkjet printer 1 according to the present general inventive concept may include an ink cartridge 10 and a waste ink container 100. The inkjet printer 1 may include a waste ink storing apparatus 200 (refer to FIGS. 5 and 6) having the waste ink container 100. The waste ink container 100 may be replaced by one of waste ink containers 100*a* and 100*b* (to be described below) according to second and third exemplary embodiments of the present general inventive concept illustrated in FIGS. 7 and 8.

The ink cartridge 10 may be installed in a carrier 5. The carrier 5 may be guided by a guide 3, and translates in transverse directions B and C with respect to a printing medium supplying direction L, carrying the ink cartridge 10 therewith to form an ink image on a printing medium.

The exemplary ink cartridge 10 is provided to be movable between a printing position, where the printing medium receives ink from printing heads 25 and 35 (to be describe below) illustrated in FIG. 3, and a nozzle-cleaning position to clean a nozzle (not illustrated) of the printing heads 25 and 35 by moving the carrier 5.

The printing heads 25 and 35 may each be manufactured as a chip type printing head formed by a semiconductor process. The printing head chip may include a plurality of nozzles (not illustrated) to eject ink therethrough, an ink chamber (not illustrated) to supply the ink to the respective nozzles, and a heater (not illustrated) to heat the ink provided in the ink chamber thereby applying an ejection force on the ink.

The ink cartridge 10 may include a color sub-cartridge 20 to store color ink therein, and a mono sub-cartridge 30 to store black ink therein. The ink cartridge 10 may move in a single body, even when comprising more than one sub-cartridge. As illustrated in FIG. 3, the sub-cartridges 20 and 30 may include casings 21 and 31, which form storage chambers 21*a* and 31*a* to store ink therein. Head supporters 23 and 33 may be accommodated within the casings 21 and 31 to form supplying chambers 23*a* and 33*a* to receive the ink from the storage chambers 21*a* and 31*a* and to supply the received ink to the printing heads 25 and 35, respectively. Ink paths (not illustrated) are formed to supply the ink stored in the storage chambers 21*a* and 31*a* to the nozzle of the printing heads 25 and 35 in the respective cartridges.

The printing heads 25 and 35 may be supported by the head supporters 23 and 33 so that the ink is ejected in a vertical direction, i.e., ejected in the same direction as the direction of the force of gravity.

The exemplary ink cartridge 10 has a rectangular shape, but is not limited thereto, and may vary in its shape. Moreover, the ink cartridge 10 and the printing heads 25 and 35 may be separately mounted to the inkjet printer 1. More specifically, the ink cartridge 10 may be detached from the inkjet printer 1 while the printing heads 25 and 35 remain attached to the inkjet printer 1.

As illustrated in FIG. 1, the waste ink container 100 may be disposed in the nozzle-cleaning position outside the region where the printing medium is conveyed.

Figure 2:
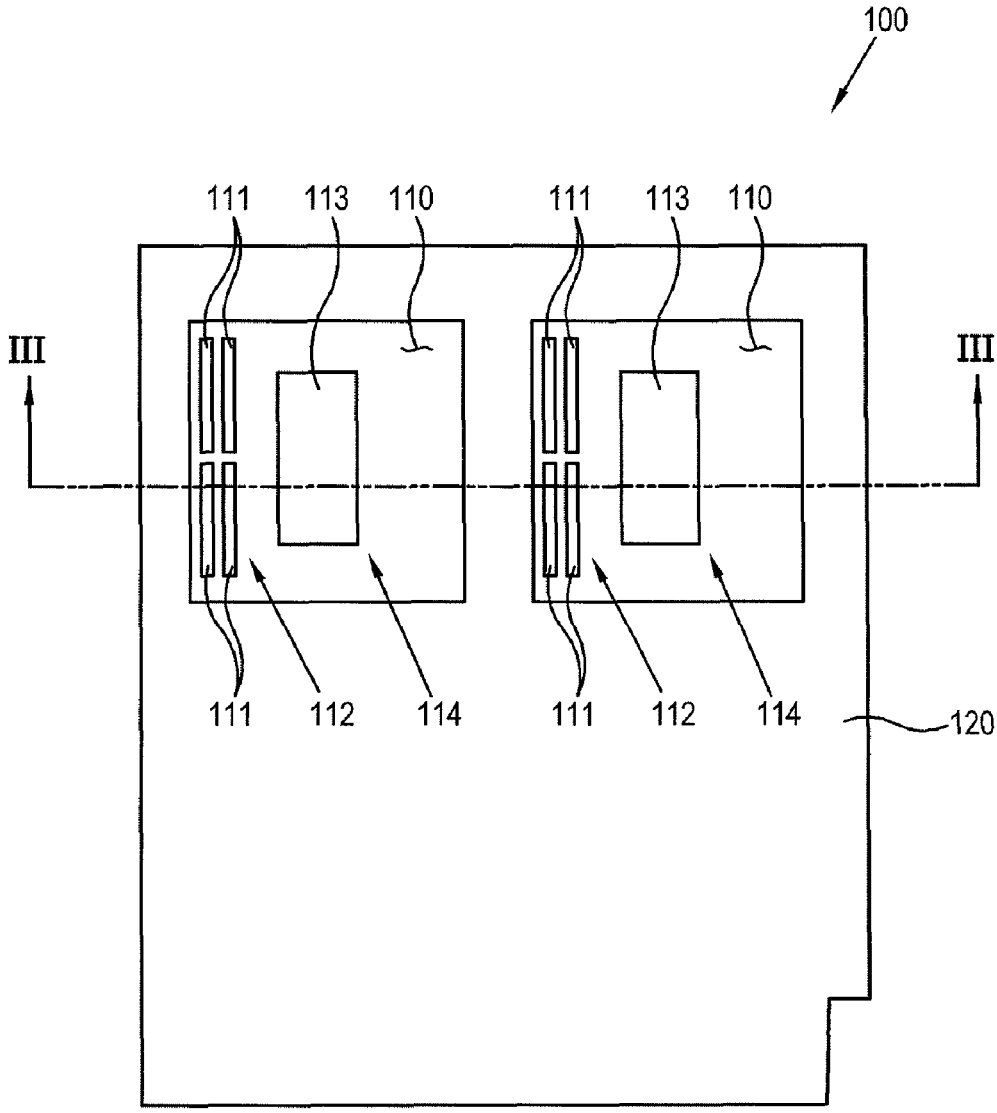
FIG. 2 is a plan view of a waste ink container according to a first exemplary embodiment of the present general inventive concept.
Figure 3:
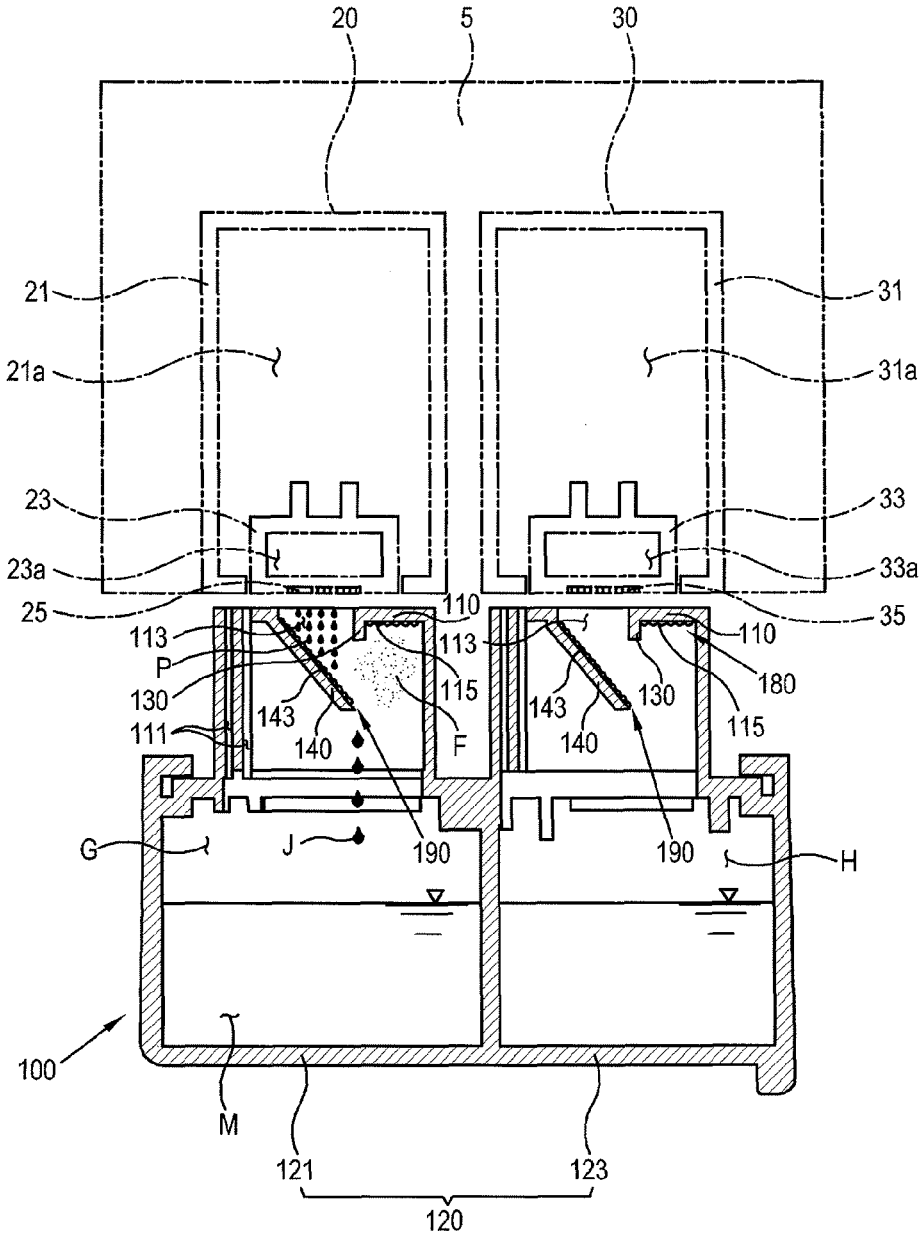
FIG. 3 is a sectional view of the waste ink container, taken along line III-III in FIG. 2.

As illustrated in FIGS. 2 and 3, the waste ink container 100 according to a first exemplary embodiment of the present general inventive concept may include a container main body 120, which forms chambers G and H accommodating the waste ink therein, a plurality of upper plates 110, which respectively define the upper part of the chambers G and H, and a plurality of discharge preventing units 130. The container main body 120 includes a plurality of container sections 121 and 123 to receive the waste ink from the color cartridge 20 and the mono cartridge 30 separately. For example, the container main body 120 may include a color container section 121, which forms a color waste ink chamber G to store the ejected waste ink of the color sub-cartridge 20, and a mono container section 123, which forms a mono waste ink chamber H to store the waste ink of the mono sub-cartridge 30 therein.

Each chamber G, H storing waste ink may have integrated thereon an upper plate 110. A first cleaning region 112 and a second cleaning region 114 may be defined on each upper plate 110 at which the waste ink is ejected to clean the nozzle of the printing heads 25 and 35. In certain embodiments of the present general inventive concept, either of the first cleaning region 112 and the second cleaning region 114 may be removed, and the shape of the first and second cleaning regions 112 and 114 may vary.

As illustrated in FIGS. 2 and 3, the first cleaning region 112 may include one or more first openings 111, and the second cleaning region 114 may include a second opening 113 that is larger than the first opening 111. In certain embodiments of the present general inventive concept, the first cleaning region 112 includes at least one first opening 111 and the second cleaning region 114 includes the second opening 113.

If a small amount of waste ink is to be ejected, the nozzle of the printing heads 25 and 35 is moved to the first cleaning region 112 to face the first opening 111. In this case, most of the ejected ink may be introduced to the chambers G and H through the first openings 111.

If a large amount of waste ink is to be ejected, i.e. if the nozzle is severely clogged or impurities are heavily disposed on the ink path, the nozzle of the printing heads 25 and 35 is moved to the second cleaning region 114 to face the second opening 113 to perform an ink-spitting operation.

The ink-spitting operation forcibly ejects ink through the nozzle of the print heads 25 and 35, where it is captured as waste ink in the waste ink container 100. The waste ink may have a distribution of droplet sizes, representatively illustrated in FIG. 3 as ink droplets P and aerosol ink droplets F. The ink droplets P include those droplets of sufficient volume to be carried by their own momentum towards the chamber G, H, generally in the direction in which they were ejected. The aerosol droplets F, however, are of a size that allows them to be suspended in the air within the chamber G, H, where the aerosol droplets F can be carried by the flow of the air and/or diffuse throughout the chamber G, H. The present general inventive concept, among other things, implements elements of a waste ink containment device 300 within the waste ink container that inhibits the ink droplets P as well as the aerosol droplets F from exiting the waste ink container 100.

Figure 4:
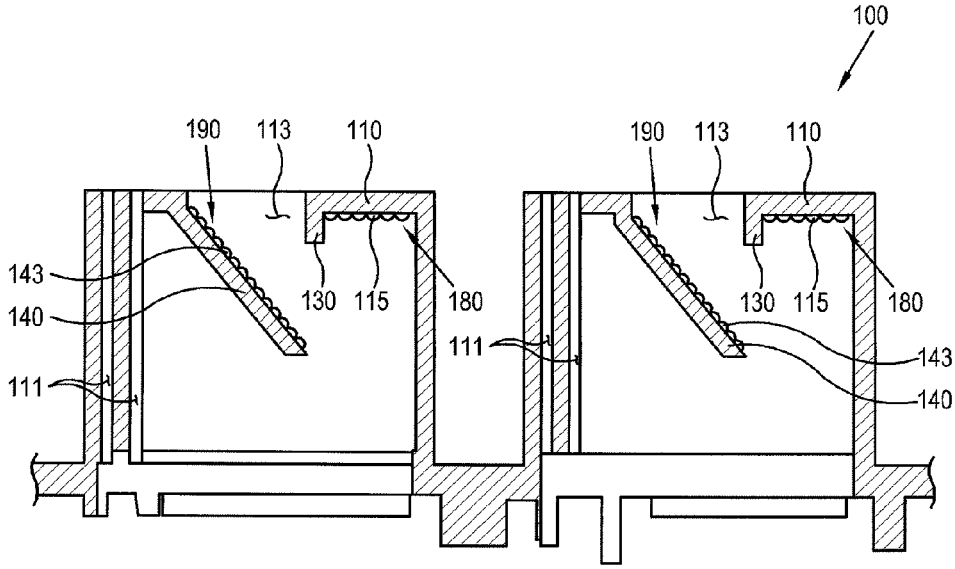
FIG. 4 is an enlarged view of certain components of the waste ink container in FIG. 3.

As illustrated in FIGS. 3 and 4, the exemplary waste ink containment device 300 includes discharge preventing unit 130, which is disposed on the periphery of the second opening 113, and extends from the upper plate 110 toward the corresponding one of the chambers G and H. The discharge preventing unit 130 prevents aerosol ink droplets F in the corresponding chamber G, H from escaping out of the waste ink container 100 through the second opening 113.

All or part of the surface of the upper plate 110 facing the chambers G and H forms an upper wetting surface 180 to accumulate aerosol droplets F by a wetting process to form larger ink drops J that fall under the influence of gravity toward the corresponding chamber G, H. The upper wetting surface 180 may include protrusions 115 that enhance the wetting process by increasing a contact area with a corresponding aerosol droplet F, thereby overcoming the surface tension that holds the droplet in its spherical form. Once the surface tension has been released, the droplet spreads on the wetting surface, and unites with the ink of other aerosol droplets F on the wetting surface 180 to ultimately form ink drops among the ink drops J. The aerosol droplets F are removed from chambers G and H by the wetting process and therefore are prevented from exiting the waste ink container 100.

As illustrated in FIGS. 3 and 4, the waste ink containment device 300 may further include an introduction guide 140 in either of both of the chambers G and H. The introduction guide 140 may be disposed as a lower wetting surface 190 within the chambers G and H to accumulate the ink droplets P introduced through the second opening 113 by the wetting process to form larger ink drops, such as those illustrated as ink drops J, that fall under the influence of gravity toward the corresponding chamber G, H.

The introduction guide 140 may be disposed at a distal end thereof from the upper plate 110 above each of the chambers G and H adjacent to the second opening 113 to be inclined toward the respective chambers G and H to intercept ink droplets P discharged from the printing heads 25 and 35 in the waste ink ejecting direction. Additionally, the introduction guide may be disposed to extend across the second opening 113 to prevent ink stored in the chambers G, H from exiting therethrough, such as through splatter.

The introduction guide 140 may further include protrusions 143 formed on the lower wetting surface 190. The protrusions 143 may be provided to increase the contact area with the ink droplets P in a manner similar to the protrusions 115 of the upper wetting surface 180. The shape of the protrusions 115 and 143 is not limited to the concavo-convex profile illustrated in FIG. 4, and may vary per application. Moreover, the protrusions 115 and 143 may be sized according to the different sizes of droplets F, P received on the respective wetting surface 180, 190, and may have varying size distributions across respective wetting surfaces 180, 190.

A cloth or attaching member having minute holes thereon may be attached to the lower wetting surface of the introduction guide 140 instead of the protrusions 143 integrally formed in the introduction guide 140. The foregoing alternative may also apply to the protrusions 115 of the upper plate 110.

An ejected waste ink droplet P and the aerosol droplets F, contact the protrusions 143 of the lower wetting surface 190 and the protrusions 115 of the upper wetting surface 180, respectively, to become larger waste ink drops J. The ink drops J subsequently fall under the influence of gravity to the corresponding chamber G, H. The waste ink drops J gather in the chambers G and H and become waste ink fluid M to be stored therein.

Figure 7:
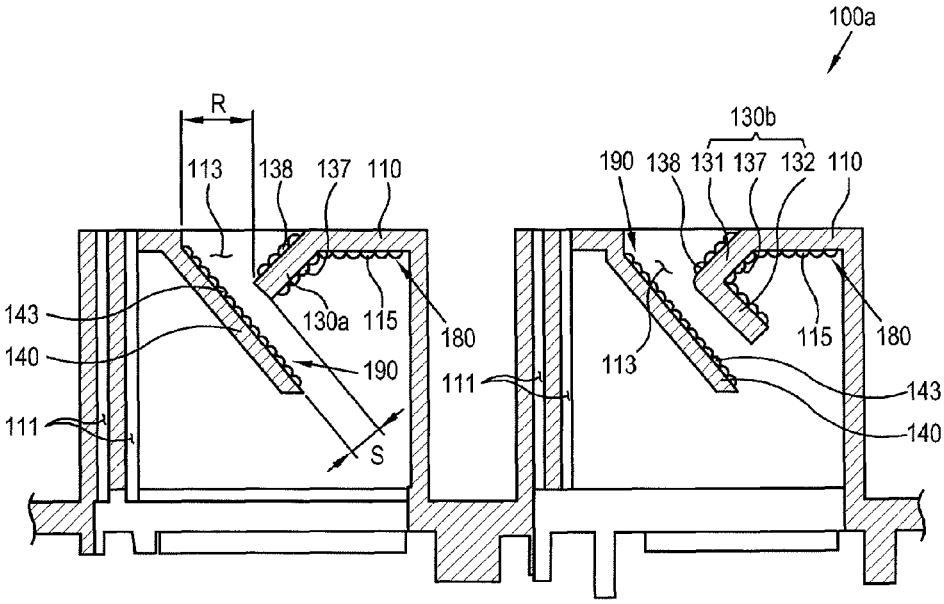
FIG. 7 is a sectional view of certain components of a waste ink container according to a second exemplary embodiment of the present general inventive concept.

As illustrated in FIG. 7, a waste ink container 100*a* according to a second exemplary embodiment of the present general inventive concept includes a first discharge preventing unit 130*a* and a second discharge preventing unit 130*b*. The shape of the discharge preventing units 130*a* and 130*b* is different from that of the discharge preventing unit 130 according to the first exemplary embodiment. Other components of the waste ink container 100*a* according to the second exemplary embodiment are the same as those previously describe with reference to the first exemplary embodiment of the present general inventive concept.

As illustrated in FIG. 7, the first discharge preventing unit 130*a* may extend in a direction toward a surface of the introduction guide 140 facing the direction from which the ejected ink is introduced into the chamber G. Thus, a gap S which is formed between the first discharge preventing unit 130*a* and the introduction guide 140, i.e., the gap S through which the waste ink droplet F is discharged, is smaller than that according to the first exemplary embodiment.

The first discharge preventing unit 130*a* may include protrusions 137, which face the chamber G. Protrusions 138 may be also formed on the surface of the first discharge preventing unit 130*a* facing the nozzle 25. If the waste ink is introduced into the second opening 113, some of the waste ink may contact the protrusions 138 of the first discharge preventing unit 130*a* and be attached by wetting to the protrusions 138. The attached waste ink may be guided to the chamber G under the influence of gravity, as described above.

The waste ink may be introduced through a partial region R of the second opening 113, such as when performing an ink-spitting operation only when the nozzle of the print head 25 is positioned in the partial region R. When the present general inventive concept is so embodied, the protrusion 138 may be removed.

The second discharge preventing unit 130*b* includes a first bent part 131, which is bent from the upper plate 110 toward a face of the introduction guide 140, and a second bent part 132, which is bent from the first bent part 131 to be parallel to the introduction guide 140. The first and second bent parts 131 and 132 may include protrusions 137, which face the chamber H.

Figure 8:
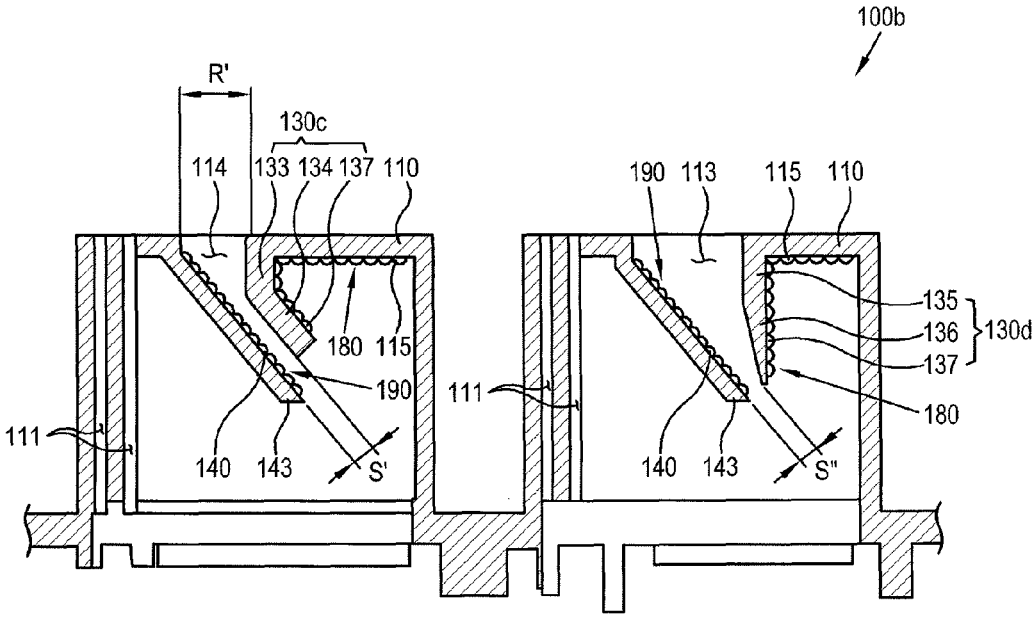
FIG. 8 is a sectional view of certain components of a waste ink container according to a third exemplary embodiment of the present general inventive concept.

As illustrated in FIG. 8, a waste ink container 100*b* according to a third exemplary embodiment of the present general inventive concept includes a third discharge preventing unit 130*c* and a fourth discharge preventing unit 130*d*. The shape of the discharge preventing units 130*c* and 130*d* and the size of a second opening 114 are different from those according to the first and second exemplary embodiments of the present general inventive concept. Other components of the waste ink container 100*b* according to the third exemplary embodiment are the same as those previously described with reference to the first and second exemplary embodiments of the present general inventive concept.

The third discharge preventing unit 130*c* may include a third bent part 133 and a fourth bent part 134.

The third bent part 133 is bent perpendicularly to the upper plate 110 toward the chamber G from a position closer to the first opening 111 of the upper plate 110 to make dimension R' of the second opening 114 smaller than the dimension R of the previously described second opening 113. The fourth bent part 134 is bent from the third bent part 133 to be parallel to the introduction guide 140 to form a gap S' that is smaller than the gap S of the previously described embodiments.

The third and fourth bent parts 133 and 134 may further include protrusions 137, which face the chamber G. As described above, the protrusions 137 attach the aerosol droplets F within the chamber G to its surface to reduce the amount of the waste ink which is suspended the chamber G.

The fourth discharge preventing unit 130*d* may include a fifth bent part 135, which is bent perpendicularly to the upper plate 110 toward the chamber H, and a chamfer part 136, which is chamfered along a bending direction of the fifth bent part 135 to decrease thickness of the fifth bent part 135. The fifth bent part 135 may extend substantially to the tip of the introduction unit 140 to form a small gap S". The gaps S, S', and S", allow ink drops J to pass into the corresponding chambers G and H, but decrease the likelihood of an errant spatter ink drop from reaching the second opening 113.

The shapes of the discharge preventing units 130*c* and 130*d* are not limited to those in FIG. 8, and may vary to prevent the waste ink droplet from being discharged per the corresponding application.

Hereinafter, the waste ink storing apparatus 200 according to the present general inventive concept will be described with reference to FIGS. 5 and 6.

The exemplary waste ink storing apparatus 200 includes the foregoing waste ink container 100.

The waste ink storing apparatus 200 may include the waste ink containment device 300 that further includes first and second cover members 210 and 250, which respectively open and close on a plurality of second openings 113. It is to be understood that the second opening 114 of FIG. 8 may also include a second cover member similar to those illustrated in FIGS. 5 and 6, and described herein with reference thereto.

The first and second cover members 210 and 250 may be provided to move in response to engagement with the movement of the printing heads 25 and 35, and open and close the second openings 113 thereby. That is, as the printing heads 25 and 35 move between the printing position and the nozzle-cleaning position, the cover members 210 and 250 open and close the second openings 113 accordingly.

The first and second cover members 210 and 250 may include first and second contact units 213 and 253, which contact, and are removed from contact with the ink cartridges 20 and 30 as the ink cartridges 20 and 30 move.

Figure 5:
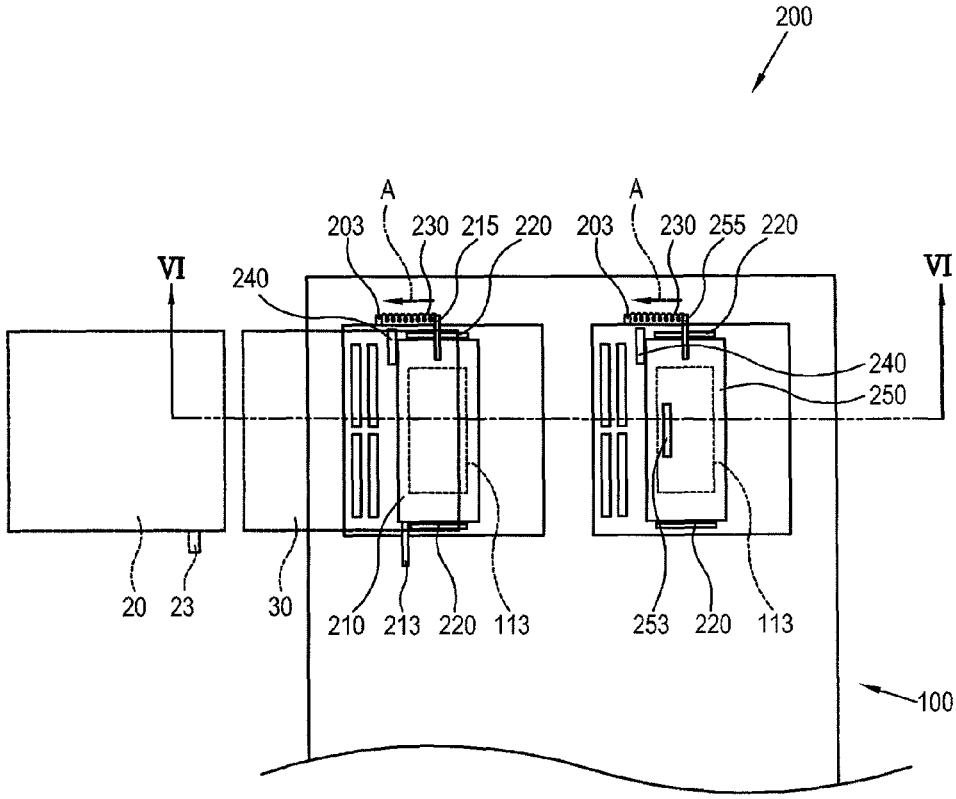
FIG. 5 is a plan view of an exemplary waste ink storing apparatus according to the present general inventive concept.
Figure 6:
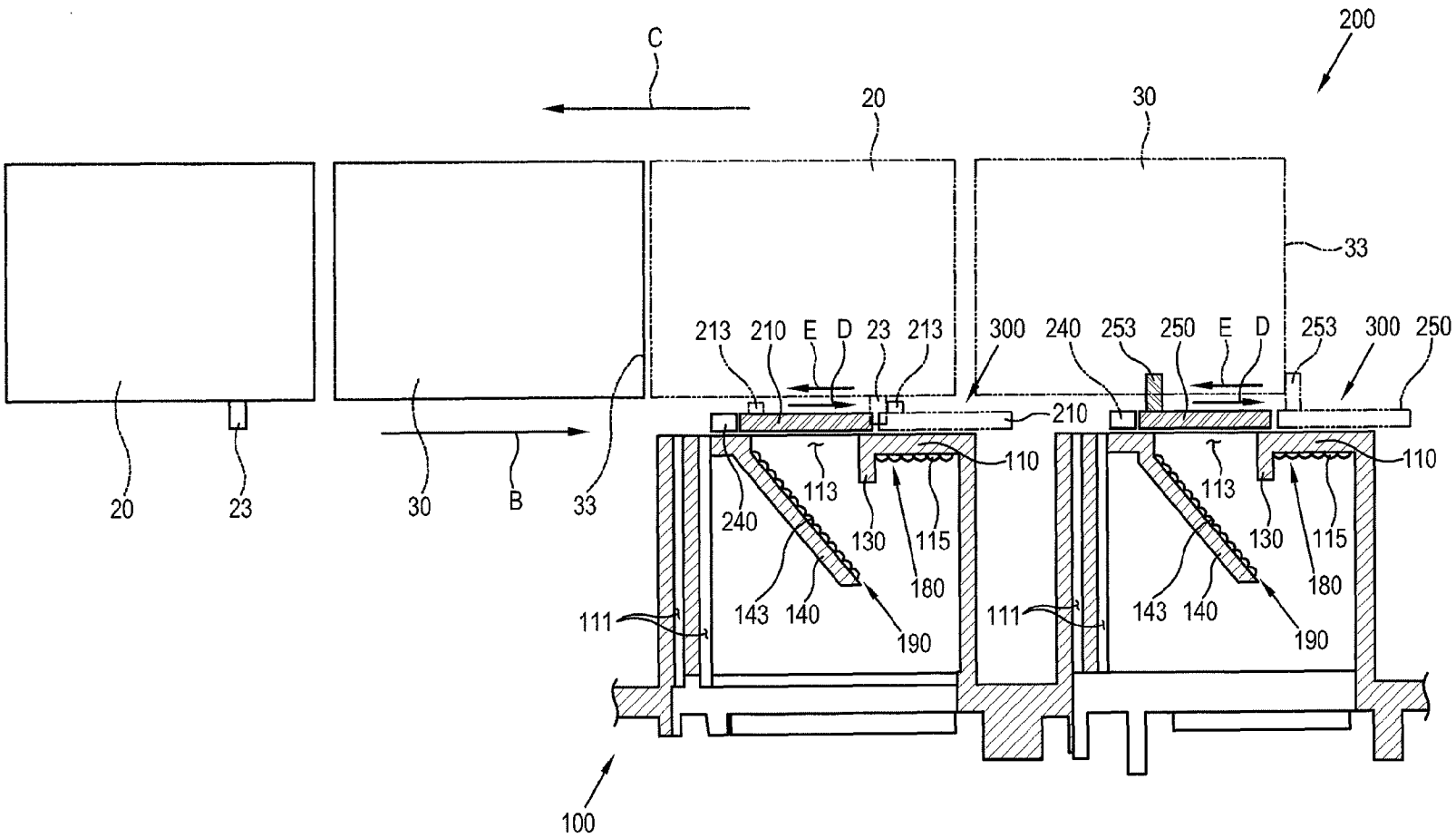
FIG. 6 is a schematic sectional view of the waste ink storing apparatus according to the present general inventive concept.

As illustrated in FIGS. 5 and 6, the first contact unit 213 may extend in a transverse direction of the waste ink-ejecting direction. The first contact unit 213 contacts the color sub-cartridge 20 so that the color ink is introduced to the second opening 113 upon the first cover member 210 being opened thereby. The first contact unit 213 may be shaped as illustrated in FIG. 5 so as to bypass the second cover member 250 on the mono sub-cartridge 30 as it proceeds to engage with the first cover member 210 on the color sub-cartridge 20.

As illustrated in FIGS. 5 and 6, the second contact unit 253 protrudes to contact a front surface 33 of the mono sub-cartridge 30 responsive to movement thereof. That is, the front surface 33 serves as a second cover operator to operate the second cover member 250.

As illustrated in FIG. 5, the waste ink storing apparatus 200 may further include a guide 220, an elastic member 230, and a stopper 240.

The guide 220 guides the sliding motion of each of the cover members 210 and 250 so as to move in the prescribed path. It is to be understood that the cover members 210 and 250 need not move in a linear path as illustrated in FIGS. 5 and 6, and the guides 220 are constructed according to the particular path along which the cover members 210 and 250 move.

The elastic member 230 applies an elastic force to the cover members 210 and 250 to bias the cover members 210 and 250 toward a closing direction A of the second opening 113. The elastic member 230 may be disposed between elastic member couplers 215 and 255 formed in the cover members 210 and 250, respectively, and a projection 203 disposed on the waste ink container 100.

The present general inventive concept is not limited to the shape and position of the elastic members 230 to achieve the elastic force on the cover members 210 and 250 toward the closing direction A of the second opening 113.

The stopper 240 limits the movement of the cover members 210 and 250 to the closed position so that the cover members 210 and 250 are biased against the stoppers 240 by the elastic force of the elastic member 230.

The operation of opening and closing the second opening 113 by the cover members 210 and 250 moving in engagement with the movement of the printing heads 25 and 35 will be described.

First, a first cover projection 23 may be formed in the color sub-cartridge 20 to contact the first contact unit 213.

As the color and mono sub-cartridges 20 and 30 move to the nozzle-cleaning position in direction B, the mono cartridge 20 passes over the first cover member 210 without contacting the first contact unit 213 of the first cover member 210, and the first cover member 210 moves in a direction D to the opening position to open the second opening 113 as the first cover projection 23 of the color sub-cartridge 20 contacts the first contact unit 213.

As the front surface 33 of the mono sub-cartridge 30 contacts the second contact unit 253, the second cover member 250 moves in the direction D to the opening position, to open the second opening 113.

Thus, the ink cartridge 10 and the printing heads 25 and 35 perform the ink-spitting operation and clean the nozzle while the second opening 113 is open.

If the ink cartridge 10 moves in a direction C after completing the ink-spitting operation, the first and second cover members 210 and 250 also move to the position to close the second opening 113 by the elastic force of the elastic member 230.

When the color sub-cartridge 20 and the mono sub-cartridge 30 are removed from contact with the first and second contact units 213 and 253, respectively, the cover members 210 and 250 over the corresponding second opening 113 are biased in the closed position by the elastic force of the corresponding elastic member 230. Thus, the waste ink within the chambers G and H is completely prevented from being discharged to the outside of the waste ink storage apparatus 200 through the second opening 113.

With the foregoing configuration, the second opening 113 of the waste ink container 100 is open only when the ink cartridge 10 moves to the nozzle-cleaning position to spit ink, and closed if the ink cartridge 10 moves out of the nozzle-cleaning position, thereby completely preventing the waste ink from contaminating the internal part of the inkjet printer 1.

As described above, the cover members 210 and 250 contact the ink cartridge 10 to move. Alternatively, the cover members 210 and 250 may be operated through contact with the carrier 5 illustrated in FIG. 1.

In certain embodiments, the cover members 210 and 250 open and close only on the second opening 113, since the waste ink droplet is discharged more often from the second opening 113 than from the first opening 111. However, the cover members 210 and 250 may also close the first opening 111 depending on the application.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An ink container, comprising:

a container main body which forms a chamber to accommodate ink therein;

an upper plate which comprises an opening to introduce an ink droplet therethrough and which covers an upper part of the chamber;

a discharge preventing unit internal to the container main body adjacent to the opening and extending toward the chamber to inhibit the ink droplet from being discharged through the opening; and an introduction guide having one end connected to the upper plate on a side of the opening opposite the discharge preventing unit, the introduction guide extending into the chamber in a direction toward the discharge preventing unit to guide the ink droplet toward the chamber upon being introduced through the opening.

2. The ink container according to claim 1, wherein the introduction guide extends across a width of the opening.

3. The ink container according to claim 2, wherein the introduction guide comprises a protrusion to increase a contact area thereof with the ink droplet.

4. The ink container according to claim 1, wherein the upper plate further comprises a protrusion facing the chamber, and which increases a contact area of the upper plate with the ink droplet.

5. An ink storing apparatus, comprising:

an ink container which comprises:

a container main body which forms a chamber to accommodate ink therein, an upper plate which comprises an opening to introduce a plurality of ink droplets therethrough and covers an upper part of the chamber, and a waste ink containment device comprising:

a discharge preventing unit which is adjacent to the opening and extending toward an interior of the chamber to inhibit the ink droplets from being discharged through the opening;

an introduction guide having one end connected to the upper plate on a side of the opening opposite the discharge preventing unit, the introduction guide extending into the chamber in a direction toward the discharge preventing unit to guide the ink droplet toward the chamber upon being introduced through the opening; and a cover member exterior to the upper plate which opens and closes the opening.

6. The ink storing apparatus according to claim 5, wherein the cover member opens and closes the opening by engaging with movement of an ink-ejecting means which ejects the ink droplet.

7. An inkjet printer, comprising:

a printing head which comprises a nozzle to eject ink therethrough, and moves between a printing position to print on a printing medium and a nozzle-cleaning position distanced from the printing position; and an ink container which comprises:

a container main body which forms a chamber to accommodate ink therein;

an upper plate which comprises an opening to introduce a plurality of ink droplets therethrough and covers an upper part of the chamber; and a waste ink containment device, comprising:

a cover member exterior to the container main body which opens and closes the opening;

an introduction guide which is disposed within the chamber and extends from the upper plate adjacent to a first side of the opening toward inside of the chamber and an opposing second side of the opening, and guides the ink droplets into the chamber upon being introduced through the opening; and a discharge preventing unit interior to the container main body adjacent to the second side of the opening to inhibit the ink droplets from being discharged through the opening.

8. The inkjet printer according to claim 7, wherein the introduction guide extends across a width of the opening.

9. The inkjet printer according to claim 8, wherein the introduction guide comprises a protrusion to increase a contact area with the ink droplets.

10. The inkjet printer according to claim 7, wherein the upper plate further comprises a protrusion which increases a contact area with the ink droplets and faces the chamber.

11. The inkjet printer according to claim 7, wherein the cover member moves between an opening position to open the opening and a closing position to close the opening in engagement with movement of the printing head moving between the nozzle-cleaning position and the printing position.

12. The inkjet printer according to claim 7, wherein the cover member is provided to slidably move parallel to the movement of the printing head.

13. The inkjet printer according to claim 12, further comprising:

an ink cartridge which stores ink therein, and moves integrally with the printing head, wherein the waste ink containment device engages and disengages the ink cartridge, and opens and closes the opening in engagement with the movement of the ink cartridge.

14. The inkjet printer according to claim 13, further comprising:

an elastic member which applies an elastic force to the cover member to close the opening when the cover member disengages the ink cartridge.

15. A waste ink container comprising:

at least one opening through which waste ink is received;

a waste ink containment device comprising:

a lower wetting surface disposed at least partially across the opening to accumulate droplets of the waste ink thereon to form ink drops; and an upper wetting surface adjacent to the opening to accumulate aerosol droplets of the waste ink thereon to form other ink drops;

a discharge preventing unit formed between the upper wetting surface and the opening to inhibit the aerosol droplets from movement into the opening; and a chamber to collect the ink drops and the other ink drops upon being released from the lower wetting surface and the upper wetting surface, respectively, wherein the discharge preventing unit extends from the periphery of the opening toward the chamber.

16. The waste ink container of claim 15, further comprising:

a top plate in which the opening is formed, wherein the discharge preventing unit is formed on the top plate on a periphery of the opening.

17. The waste ink container of claim 15, wherein the discharge preventing unit includes a bend on a portion thereof extending toward the chamber to define a plurality of bent parts.

18. The waste ink container of claim 17, wherein any or all of the bent parts have formed thereon a plurality of protrusions to increase a contact area with the aerosol droplets.

19. The waste ink container of claim 17, wherein a distal one of the bent parts is parallel to the lower wetting surface.

20. The waste ink container of claim 17, wherein a proximal one of the bent parts is perpendicular to the upper wetting surface.

21. The waste ink container of claim 15, wherein the discharge preventing unit extends from the periphery of the opening toward the lower wetting surface.

22. The waste ink container of claim 15, wherein at least one of the upper wetting surface and the lower wetting surface has formed thereon a plurality of protrusions to increase a contact area with the droplets.

23. The waste ink container of claim 15, wherein the waste ink containment device further comprises:

a cover member disposed over the opening to be operated into an open position exposing the opening, and a closed position covering the opening.

24. An inkjet printing apparatus comprising:

at least one print head to print indicia on a printing medium with ink supplied thereto, the print head being selectively removed from a printing region at which the printing medium is provided to a cleaning region removed from the printing region and at which the print head forcibly ejects the ink to clean nozzles formed therein;

a waste ink container at the cleaning region to receive the ink forcibly ejected by the print head as waste ink thereat, the waste ink container comprising:

an upper plate having formed therein an opening to receive the waste ink therethrough;

a chamber to collect the waste ink; and a waste ink containment device, comprising:

a discharge prevention unit having a proximal end thereof coupled to the upper plate and having a distal end thereof extending into the chamber from the upper plate to inhibit the waste ink from movement into the opening; and an introduction guide having a proximal end thereof coupled to the upper plate opposite the opening from the proximal end of the discharge preventing unit and a distal end extending towards the chamber and across the opening.

25. The inkjet printing apparatus of claim 24, wherein the waste ink containment device further comprises:

a cover member disposed on the upper plate over the opening, the cover member being operable into an open position exposing the opening and a closed position covering the opening.

26. The inkjet printing apparatus of claim 24, wherein the discharge preventing unit extends from the upper plate to form an upper wetting surface adjacent the opening to inhibit aerosol ink droplets from movement into the opening.

* * * * *